United States Patent [19]

Kaufman

[11] 4,360,481

[45] Nov. 23, 1982

[54] FUEL SUPPLY METERING ARRANGEMENT

[75] Inventor: Vernon R. Kaufman, Cedarburg, Wis.

[73] Assignee: Tecumseh Products Company, Tecumseh, Mich.

[21] Appl. No.: 115,907

[22] Filed: Jan. 28, 1980

[51] Int. Cl.[3] ..... F02M 1/10

[52] U.S. Cl. ..... 261/39 R; 261/71; 261/DIG. 38; 261/DIG. 68; 236/102; 137/468

[58] Field of Search ..... 261/DIG. 38, 71, 39 R, 261/DIG. 68; 137/533.11, 468; 236/102

[56] References Cited

U.S. PATENT DOCUMENTS

| | | | |
|---|---|---|---|
| 1,103,802 | 7/1914 | Meissner | 261/DIG. 38 |
| 1,529,407 | 3/1925 | Coleman | 261/DIG. 38 |
| 1,623,668 | 4/1927 | Fisher | 261/63 |
| 2,464,328 | 3/1949 | Mallory | 261/DIG. 38 |
| 2,830,621 | 4/1958 | Prescott | 261/DIG. 38 |
| 3,055,391 | 9/1962 | Shuk et al. | 137/533.11 |
| 3,166,611 | 1/1965 | Conant et al. | 261/DIG. 38 |
| 3,484,084 | 12/1969 | Simpson et al. | 261/DIG. 38 |
| 3,696,997 | 10/1972 | Gifford | 236/102 |
| 3,719,322 | 3/1973 | Gifford | 236/102 |
| 3,771,556 | 11/1973 | Gifford | 137/533.11 |
| 3,833,171 | 9/1974 | Gifford | 236/102 |
| 3,992,490 | 11/1976 | Preston | 261/DIG. 68 |
| 4,053,544 | 10/1977 | Moore | 261/DIG. 38 |
| 4,123,479 | 10/1978 | Andreassen | 261/DIG. 38 |

FOREIGN PATENT DOCUMENTS

| | | | |
|---|---|---|---|
| 65206 | 2/1913 | Switzerland | 261/71 |
| 1294476 | 10/1972 | United Kingdom | 261/DIG. 38 |

*Primary Examiner*—Tim R. Miles

*Attorney, Agent, or Firm*—Albert L. Jeffers; Roger M. Rickert

[57] ABSTRACT

A carburetion system for an internal combustion engine having improved fuel metering is disclosed and includes a fuel supply conduit which is formed in a portion of the body of the carburetor extending from a fuel source to the carburetor bore with that carburetor body portion having a first linear temperature coefficient of expansion. A mixture control member formed of a material having a second linear temperature coefficient of expansion engages the body in a first region and defines relative to the carburetor body in a second remote region a fuel metering orifice for controlling fuel flow through the fuel supply conduit. The mixture control member may be moved relative to the first and second regions to change the fuel to air ratio supplied to the engine. Employing a fuel metering orifice in the adjustable fuel metering arrangement, the minimum flow area of which has a simply connected convex cross sectional configuration, minimizes the adverse effects of ambient temperature changes. The carburetor includes a one-way check valve in series between a fuel source and a fuel discharge nozzle comprising a valve housing having a fuel inlet coupled to the fuel source and a fuel outlet coupled to the discharge nozzle with a valve ball captive within the housing and movable between a closed position adjacent to the fuel inlet and an open position laterally displaced relative to the path of fuel flow through the valve housing.

5 Claims, 5 Drawing Figures

FUEL SUPPLY METERING ARRANGEMENT

BACKGROUND OF THE INVENTION

The present invention relates generally to arrangements for controlling a liquid fuel flow and more particularly to such arrangements employed in internal combustion engine carburetion systems with a view toward making such systems less susceptible to dirt or moisture blockage as well as compensating such systems for environmental temperature changes.

For exemplary purposes the present invention will be described in the environment of a diaphragm carburetor having an adjustable idle metering system and a fixed main metering system.

In present day diaphragm carburetors having adjustable idle and main metering systems, fuel will not flow through the main metering system until the air velocity through the venturi or carburetor throat is relatively high as caused by either high engine speed or loading the engine. This relatively high velocity and correspondingly low pressure required for main metering system fuel flow occurs because the pressure in the diaphragm cavity must be below atmospheric pressure by an amount sufficient to overcome the weight of the diaphragm assembly and the fuel resting on the diaphragm as well as the spring force exerted on the inlet needle valve for fuel to flow into the diaphragm cavity. This reduced pressure also affects the main discharge nozzle check valve so that a relatively high velocity of air movement through the carburetor venturi is required before the venturi pressure drop is sufficiently great to open the check valve allowing fuel flow to occur. Thus, unless the engine is run at a high rate of speed or subjected to a load, the main fuel nozzle may not be supplying fuel to the engine when adjustments to the main fuel nozzle needle valve are made, resulting in an improper richness setting of that needle valve and a reduction in overall performance of the engine.

The typical diaphragm carburetor also requires a check valve in the main metering system to prevent any air flow from the main discharge nozzle to the diaphragm cavity and into the idle metering system thereby causing the engine to stall when the speed is dropped to idle or causing the engine speed to be erratic if governed at moderate no load speeds. Such check valves are diposed in line with the valve seats with only a small portion of the valve or seat being washed by fuel flow through the assembly. Dirt, moisture and other deleterious materials can adhere to portions of the valve or seat not being cleansed by the fuel flow with such particles preventing the valve from closing when the engine speed is decreased to idle permitting air to backbleed into the idle system and causing the engine to stall.

Carburetor needle valves typically have a conically tipped adjusting needle which fits into a round orifice to form a metering cross section of generally annular configuration, the cross sectional area of which is controlled by the degree of penetration of the conical tip into the orifice. This small annulus tends to strain particles of a size smaller than those removed by the fuel system filter and has a large wetted surface area where ice can form restricting flow. Moisture accumulation and other surface tension problems may also restrict the fuel flow opening. As these particles are filtered at the annulus or as particles may accumulate downstream of the orifice due to turbulence, the area or effective fuel limiting dimension is reduced with a corresponding reduction in fuel flow causing the fuel-air ratio to become progressively more lean until engine performance becomes unacceptable. At this time, the mixture richness may be increased by withdrawing the conical adjusting needle tip from the orifice to bring the fuel limiting dimension or area back to a value to provide the correct fuel-air mixture ratio while at the same time increasing the particle limiting dimension between the orifice surface and the conical needle end surface, allowing the foreign material trapped at the annulus or the accumulation downstream to be flushed on through the system. Within a short period of time the fuel-air ratio now becomes too rich, again resulting in unacceptable engine performance and requiring a reinstatement of the original needle valve setting for optimum performance. One system for improving the ratio of minimum linear extent of the orifice to orifice area is to provide a tapered groove along the end portion of the adjusting needle.

Carburetion compensation to accommodate the fuel-air ratio to varying ambient conditions is known in a wide variety of forms including continuously variable automatic choke arrangements and operator accessible mixture controls. In small engine carburetor designs where simplicity and economy are paramount considerations, a rudimentary two or three position manual choke which is closed to start and opened to run, is generally the only control available to the operator. Such carburetors have in the past been set richer for winter starting and operation and more lean for normal summer starting and operation. Even seasonal equipment such as lawnmowers and snowthrowers are not used under constant environmental conditions. For example, a snowthrower might be used at ambient temperatures of 45° F. in bright sunshine or at −20° F. in the evening or on an overcast day. Optimum performance over such a relatively wide temperature range has been extremely difficult to achieve. Even with seasonally used equipment, the effects of temperature changes has made the manufacture or maintenance of such equipment during the off-season difficult. A significant cause of these problems is now believed to be the effect of temperature on the operation of the fuel metering system.

SUMMARY OF THE INVENTION

Among the several objects of the present invention may be noted the provision of a carburetor which is self-compensating for temperature changes; the provision of a metering orifice less susceptible to dirt, moisture and the like; the provision of a carburetor having only one adjustable mixture control; the provision of a check valve arrangement for a carburetor fuel metering system which is less susceptible to dirt, moisture and the like; the provision of a check valve arrangement according to the previous object which tends to be self-cleansing; the provision of a carburetor with a single mixture adjustment needle which exerts a measure of control over both idle and main running fuel metering systems; the provision of a single adjust temperature compensating dirt resistant diaphragm carburetor; and the provision of an improved fuel metering orifice configuration which provides an increased particle limiting dimension for a given fuel flow limiting dimension, that is, an orifice configuration in which the ratio of minimum linear extent of the orifice to orifice area is greater than that ratio for an annular orifice. These as well as other objects and advantageous features of the present invention will be in part apparent and in part pointed out hereinafter.

In general, an improved fuel supply metering arrangement for a carburetor includes an idle fuel supply conduit formed in a region of the body of the carburetor having a first linear temperature coefficient of expansion which conduit extends from the fuel supply chamber of the carburetor to the bore of the carburetor. A mixture control member is formed of a material having a second, for example greater, linear temperature coefficient of expansion which threadingly engages the carburetor body and extends into the idle fuel supply conduit with one end thereof extending into a restricted region of that conduit for controlling fuel flow according to the extent of penetration of the control member into the restricted region. Forming a tapered fuel flow control notch between the conduit restricted region and the mixture control member of a simply connected convex configuration reduces the deleterious effects of the increase of fuel viscosity with decreasing temperature.

Also in general and in one form of the invention, a self-cleansing one-way check valve is disposed in series between a fuel source and a fuel discharge nozzle in a carburetor and includes a valve housing having a fuel inlet coupled to the fuel source and a fuel outlet coupled to the discharge nozzle with a valve ball captive within the housing and movable between a closed position adjacent the fuel inlet and an open position laterally displaced relative to the path of fuel flow through the valve housing from the fuel inlet to the fuel outlet.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
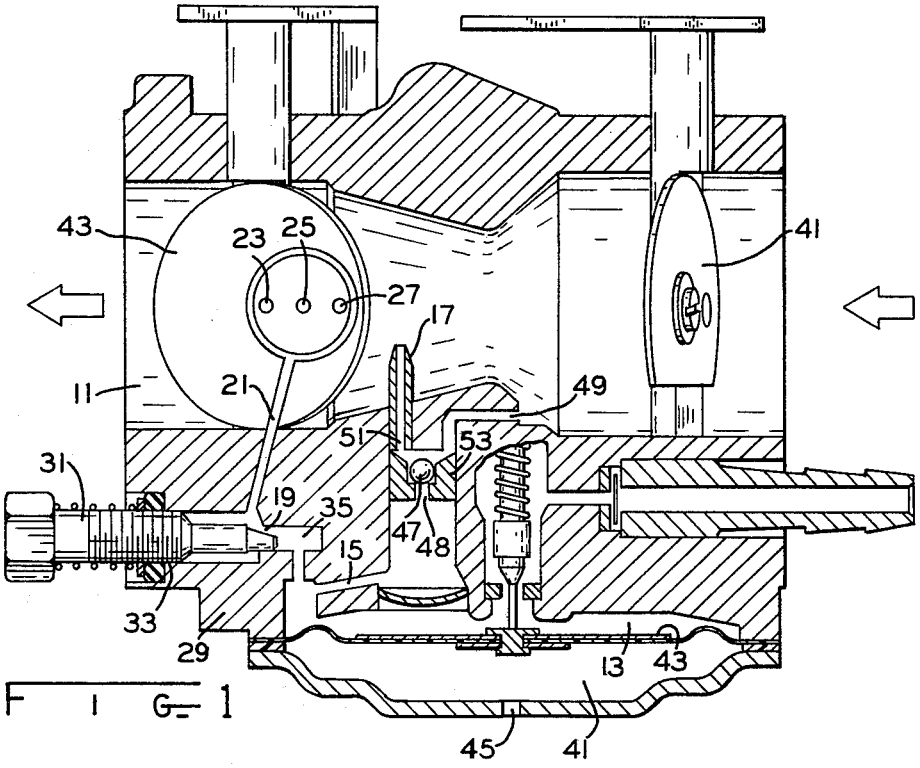
FIG. 1 is a view primarily in cross section of a diaphragm type carburetor incorporating the present invention.
Figure 2:
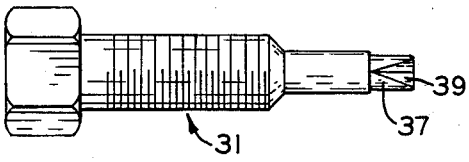
FIG. 2 is a plan view of a mixture control member for the carburetor of FIG. 1.

The carburetor of FIG. 1 provides a combustible fuel-air mixture at the bore outlet 11 to a conventionally aspirated internal combustion engine. The carburetor has a diaphragm type pressure regulated fuel supply chamber 13 from which fuel is supplied by way of a fixed size main fuel supply metering orifice 15 to a main discharge nozzle 17. Fuel from the fuel supply chamber 13 is also supplied by way of an adjustable idle fuel supply metering orifice 19 and idle fuel supply conduit 21 to apertures 23, 25 and 27 in the sidewall of the carburetor bore. The idle fuel supply conduit 21 is formed in a region of the body 29 of the carburetor with this conduit extending from the fuel supply chamber 13 to the carburetor bore apertures 23, 25 and 27. The mixture control member 31 is formed of a dissimilar material such as a so-called forty-three percent glass filled Nylon, however, many other thermoplastic materials could be employed. The mixture control member 31 threadingly engages the carburetor body as at 33 and extends into the idle fuel supply conduit 35. The idle fuel supply conduit includes a restricted region 35 which closely fits a notched cylindrical portion 37 of the mixture control member so that the extent of penetration of notched cylindrical portion 37 into the restricted region 35 functions to control the quantity of fuel flowing in the idle fuel supply conduit.

Figure 3:
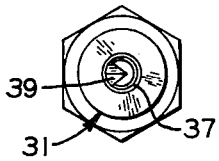
FIG. 3 is an end view of the mixture control member of FIG. 2.
Figure 4:
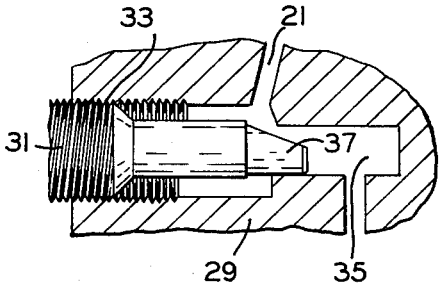
FIG. 4 is a sectional view of the idle fuel supply conduit and mixture control member portion of the carburetor of FIG. 1.
Figure 5:
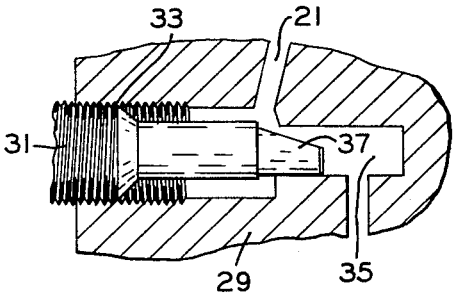
FIG. 5 is a view similar to FIG. 4 but illustrating the effect of a change in penetration of the mixture control member on the idle fuel metering system.

The generally tapering V-shaped notch 39 extends substantially the entire axial length of the cylindrical portion 37 of the mixture control member sloping as viewed in FIGS. 1, 4 and 5 at about 30° to the horizontal and forming a central angle as viewed in FIG. 3 of about 90°. This V-shaped notch in conjunction with a portion of the restricted cylindrical region 35 defines the idle fuel supply limiting orifice which is of a generally pie-shaped cross-sectional configuration with the cross-sectional area thereof diminishing as the cylindrical portion 37 moves further into the cylindrical restriction 35. Thus, a temperature increase causes the increase in penetration from, for example, that illustrated in FIG. 4 to that illustrated in FIG. 5 of the mixture control member cylindrical portion 37 into the cylindrical restriction 35, decreasing fuel flow and causing a leaning of the fuel-air mixture supplied to the engine.

A typical sequence of events in the operation of the carburetion system of the present invention would include the choke butterfly valve or shutter 41 being in its closed position, as illustrated in FIG. 1, while the throttle butterfly valve or shutter 43 was in its normally open position for priming and starting an engine. Priming is achieved by pressurizing region 41 which is on the side of diaphragm 43 opposite the fuel supply chamber 13. While the region 41 is normally at atmospheric pressure, a manually operable primer bulb, not shown, is connected to the opening 45 for momentarily increasing the pressure in region 41 to force fuel through idle conduit 21 and out of the three openings 23, 25 and 27 in the sidewall of the carburetor bore. This increase in pressure in the region 41 also forces fuel through the main metering orifice 15, past check valve ball 47, and out both the main fuel nozzle 17 and the additional bore opening 49. Release of the pressure in region 41 after this priming operation allows some air backbleeding through the openings 23, 25 and 27, as well as a minor amount of backbleeding through bore opening 49 and nozzle 17, however, the check valve ball 47 moves to the position illustrated in FIG. 1, blocking further air backbleeding through that check valve. When the engine is then cranked and started, with valves 41 and 43 remaining in the position illustrated, there is a fuel flow from both the idle openings 23, 25 and 27 and from main nozzle 17 and the additional bore opening 49. After the engine is started, the choke valve or butterfly valve 41 would be opened, and the throttle valve or butterfly 43 closed, so that the engine runs in its normal idle or low speed configuration with fuel emanating only from the idle opening 23. At this idle or low speed operation, check valve ball 47 remains in its closed position as illustrated in FIG. 1. Engine speed may then be increased by opening throttle valve 43 and allowing fuel to emanate from both opening 23 and 25 while the check valve 47 still remains in its closed position. At a wide open throttle setting, fuel emanates from all three idle openings 23, 25 and 27 and as well from the main fuel nozzle 17, and at such a wide open throttle setting, check valve ball 47 moves upward from the position illustrated in FIG. 1 to a position laterally displaced from the path of fuel flow through the check valve from the inlet 48 to the main discharge nozzle fuel outlet at 51.

The function of the check valve is for preventing air flow from the main fuel supply metering orifice 15 toward the idle fuel supply metering orifice 19. The check valve is a one-way valve comprising a valve housing 53 having the fuel inlet 48 and the main discharge nozzle fuel outlet 51 with the valve ball 47 being captive within the housing and movable between the closed position adjacent the fuel inlet, as illustrated in FIG. 1, and an open position where the ball 47 is laterally displaced relative to the path of fuel flow through the check valve.

Returning now to the needle valve or mixture control member 31, this needle expands more rapidly than the housing as temperature increases. "ZYTEL" 70G43L glass filled Nylon has been advantageously employed as a material for this needle. Prior carburetor systems typically employ a steel needle valve having an expansion coefficient which is less than the coefficient for the aluminum carburetor housing. Thus, the prior art steel needle tends to expand less than the carburetor housing, in effect creating a richer mixture at higher temperatures directly opposite to the desired effect. The differences in fuel flow rate which may be accounted for due to dissimilar expansion between prior art steel needles and the needle of the present invention over normal seasonal temperature differences is on the order of 2% to 3%. Of course, a material such as steel having a lesser temperature expansion coefficient could advantageously be employed in a metering system where the metering arrangement was differently designed so as to close with increasing temperature when the expansion of the needle was less than that of the carburetor housing.

Another and apparently more significant feature contributing to the improved performance of the idle fuel metering arrangement of the present invention is the cross sectional configuration of the minimum flow area of the fuel metering orifice. Most prior art fuel metering arrangements employ an annular or double connected minimum flow area as defined between a tapered hole and the tapered end of the fuel flow adjusting needle. As noted earlier, such annular areas may trap particles due to their restricted radial dimension. At low temperatures, this restricted radial dimension may create an enhanced likelihood of ice formation and at such lower temperatures the fuel mixture viscosity is elevated and the flow restricted due to the corresponding increase in boundary layer thickness. While simply connected convex minimum flow area configurations such as notched ends on fuel flow adjustment needles are not per se new, their low temperature behavior has not heretofore been investigated, the advantages thereof realized, nor have they been incorporated into carburetor systems to minimize the adverse effects of changes in ambient temperature in adjustable fuel metering arrangements.

Tests indicate that substantially temperature independent flow rates may be achieved so long as the perimeter to area ratio is maintained less than about 400.

In summary then, the adverse effects of changes in ambient temperature on an adjustable fuel metering arrangement may be minimized by reducing either the deleterious effects of the increase of fuel mixture viscosity with decreasing temperature or diminishing the likelihood of fuel metering orifice icing problems, or both, by employing a fuel metering orifice having a minimum flow area which is a simply connected convex cross sectional configuration with preferably a perimeter to area ratio below about 400 when the dimensions are expressed in inches. Also preferably, the majority of the perimeter of that minimum flow area is formed of a thermoplastic material and typically as a tapered V shaped notch in the thermoplastic material.

The generally pie-shaped region of minimum flow area defined between the V shaped groove in the thermoplastic needle and the cylindrical side wall of the idle fuel supply conduit is truly a simply connected convex region. The precise mathematical meaning of simply connected comes from topology and describes a region of a plane which has a single closed curve as its boundary, as opposed, for example, to a cross section of a torus which has two closed curves at its boundary as in the prior art annular region between the tapered needle and the corresponding aperture in a fuel supply conduit. With similar mathematical precision, such a simply connected region is convex if the straight line segment connecting any two points of the region lies wholly within the region. Terms such as simply connected convex region are, however, used in the present specification and claims to include not only those regions which fit the precise definitions but also regions which do not differ significantly in function from regions which do fit the precise mathematical definitions. Thus, for example, a needle notch which had one or more of the sides bowed inwardly somewhat or a minimum flow area which was a combination of a narrow annular region and a notch would be included within the scope of a simply connected convex region as that term is used herein.

From the foregoing, it is now apparent that a novel fuel supply metering arrangement for a carburetor system has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. In a carburetor for providing a combustible fuel-air mixture to a conventionally aspirated internal combustion engine having a diaphragm type pressure regulated fuel supply chamber, a fixed size main fuel supply metering orifice and an adjustable idle fuel supply metering orifice with the main fuel supply metering orifice being independent of the idle fuel supply metering orifice and having a check valve in series with the main fuel supply metering orifice for preventing air flow from the main fuel supply metering orifice toward the idle fuel supply metering orifice, an improved temperature compensating fuel supply metering arrangement comprising: an idle fuel supply conduit formed in a region of the body of the carburetor extending from the fuel supply chamber to the bore of the carburetor, a mixture control member formed of a material having a temperature expansion coefficient greater than the temperature expansion coefficient of the body of the carburetor, the mixture control member threadingly engaging the carburetor body, and extending into the idle fuel supply conduit, the mixture control member having generally cylindrical means near the end thereof within the fuel supply conduit extending into and closely fitting a generally cylindrical restricted region thereof for controlling fuel flow according to the extent of penetration of the control member into the restricted region, the mixture control generally cylindrical means fitting closely within the restricted cylindrical region and having a generally tapering V-shaped notch extending along one side thereof of varying depth with the depth being greater near the said one end to define an idle fuel supply limiting orifice of generally pie-shaped cross-section between the V-shaped notch and the restricted cylindrical region to define a minimum fuel flow area having a perimeter to area ratio less than about 400 when all measurements are made in inches, carburetor body temperature increase causing an increased penetration of the cylinder means of the mixture control member into the restricted region of the fuel supply conduit and correlative reduction in fuel flow to thereby minimize the adverse effects of ambient temperature changes on carburetor operation.

2. The fuel supply metering arrangement of claim 1 wherein the check valve is a one way valve comprising a valve housing having a fuel inlet and a main discharge nozzle fuel outlet, and a valve ball captive within the housing and movable between a closed position adjacent the fuel inlet and an open position laterally displaced relative to the path of fuel flow through the check valve from the inlet to the main discharge nozzle fuel outlet.

3. The fuel supply metering arrangement of claim 1 wherein the notch is sloped at an angle of about 30 degrees relative to the axis of the cylindrical means of the mixture control member.

4. In a carburetor for providing a combustible fuel-air mixture through the bore thereof to a conventionally aspirated internal combustion engine having a carburetor body and a fuel supply chamber communicating with a fixed size main fuel supply metering orifice and an adjustable idle fuel supply metering orifice, an improved temperature compensating fuel supply metering arrangement comprising:

an idle fuel supply conduit formed in a region of the body of the carburetor having a first linear coefficient of expansion and extending from the fuel supply chamber to the bore of the carburetor;

a mixture control member formed of a material having a second linear coefficient of expansion greater than the first linear coefficient of expansion threadingly engaging the carburetor body and extending into the idle fuel supply conduit, the mixture control member having generally cylindrical means near the end thereof within the idle fuel supply conduit extending into a generally cylindrical restricted region thereof for controlling fuel flow according to the extent of penetration of the control member into the restricted region, the generally cylindrical means of the mixture control member fitting closely within the restricted cylindrical region and having a notch extending along one side thereof of varying depth with the depth being greater near the said one end, a change in carburetor temperature causing a correlative change in the extent of penetration of the control member into the restricted region thereby varying the fuel-air mixture ratio inversely as a function of carburetor temperature; and a one way check valve in series with the main fuel supply metering orifice comprising a valve housing having a fuel inlet and a main discharge nozzle fuel outlet, and a valve ball captive within the housing and movable between a closed position adjacent the fuel inlet and an open position laterally displaced relative to the path of fuel flow through the check valve from the inlet to the main discharge nozzle fuel outlet.

5. The fuel supply metering arrangement of claim 4 wherein the notch is a generally tapering V-shaped notch.

* * * * *